United States Patent [19]

Chabot

[11] 4,234,100

[45] Nov. 18, 1980

[54] CONTAINER LID HAVING VENTING MEANS

[75] Inventor: Jean-Marie Chabot, St. Damien Bellechasse, Canada

[73] Assignee: Les Industries Procinciales Ltee, St. Damien Bellechasse, Canada

[21] Appl. No.: 46,720

[22] Filed: Jun. 8, 1979

[30] Foreign Application Priority Data

May 25, 1979 [CA] Canada ..... 328350

[51] Int. Cl.[3] ..... B65D 41/16; B65D 43/06; B65D 55/00

[52] U.S. Cl. ..... 220/306; 220/366; 206/508; 229/43

[58] Field of Search ..... 220/306, 366, 367, 380; 229/43; 206/508

[56] References Cited

U.S. PATENT DOCUMENTS

| | | | |
|---|---|---|---|
| 3,381,872 | 5/1968 | Holder et al. | 220/366 X |
| 3,895,736 | 7/1975 | Swett | 220/306 |
| 4,051,951 | 10/1977 | Smith | 206/508 |
| 4,194,645 | 3/1980 | Zelner et al. | 220/306 |

*Primary Examiner*—George T. Hall
*Attorney, Agent, or Firm*—Cushman, Darby & Cushman

[57] ABSTRACT

A container lid for packaging principally air contaminative products comprises a generally circular body with a main central portion and a downwardly extending peripheral lip portion adapted to snap over and engagedly receive the top rim portion of a container in sealed relationship; the underface of the main central portion terminates at the periphery thereof with an upstanding side wall contiguous with the lip portion; the side wall has an upper peripheral portion inwardly spaced from and defining with the lip portion a receiving portion for the rim portion of the container and a lower peripheral portion provided with a series of radially inward and circumferentially spaced air and fluid outlet cavities extending to the underface of the main central portion so that air and fluid expulsion from the container may be allowed even after the lower peripheral portion of the side wall has contacted the rim portion of the container; as the container lid is further pressed down into the container, the upper peripheral portion of the side wall then sealingly engages the rim portion of the container.

8 Claims, 7 Drawing Figures

CONTAINER LID HAVING VENTING MEANS

FIELD OF THE INVENTION

The present invention relates to a container lid and, more particularly, to a vented container lid for use in packaging mainly air contaminative products.

BACKGROUND OF THE INVENTION

To preserve certain food products, such as meat or fish, when packaged in containers, brine is added to completely drown the products before the lid is put on. However, some of the lids used to seal the containers are so shaped that they allow air to be trapped inside the closed container and to contact the products, which immediately begins the deterioration process of the products. These lids are not constructed so as to enable the expulsion of all air as the lid is forced onto the filled container.

OBJECTS AND STATEMENTS OF THE INVENTION

It is an object of this invention to provide a container lid which permits the outflow of air and brine as it is gradually pressed down on the pickled products and the container. The construction is such as to maintain a continuous outflow of air and fluid material thereby preventing at anytime an inflow of air during lid engagement with the container. This is achieved by providing along a peripheral portion of the lid cavities that allow the outward movement of the air and brine even after a first engagement by a peripheral portion of the lid at the upper rim of the container. The continuous outflow is maintained until there is achieved a full sealing engagement between the container rim and the peripheral portion of the lid.

The present invention, therefore, relates to a container lid for packaging principally air contaminative products which comprises: a generally circular body having a main central portion and a downwardly extending peripheral lip portion adapted to snap over and engage the top rim portion of the container in sealed relationship; the main central portion includes a top face and an underface and terminates at the periphery thereof with an upstanding side wall contiguous with the lip portion, the side wall including an upper peripheral portion inwardly spaced from and defining with the lip portion a rim-receiving portion for the container; the side wall has a lower peripheral portion provided with a series of radially inward and circumferentially spaced cavities extending to the said underface so that air and fluid inside the container may be expelled from the container even after the lower peripheral portion has come into engagement with the rim portion of the container; as the container lid is further pressed down into the container, the upper peripheral portion of the side wall sealingly engages the rim portion of the container.

In a preferred form of the invention, the underface includes a central downwardly projecting portion that initiates radial air expulsion towards the cavities as the lid is first placed on the container or products therein.

In another embodiment of the invention, the underface includes radial guide ribs that direct air and fluid radially toward the side wall and prevent the meat or fish products to reach air bubbles which could still remain at the underface of the central body portion of the container.

In another form of the invention, the top face of the lid includes a series of circumferentially spaced blocks that each have a top recess to receive the bottom rim of a superposed container. These blocks are the counterpart portions of the cavities formed in the underface of the lid.

The scope of applicability of the present invention will become apparent from the detailed description given hereinafter; it should be understood, however, that the detailed description, while indicating preferred embodiment of the invention, is given by way of illustration only since various changes and modifications within the spirit and scope of the invention will become apparent to those skilled in the art.

IN THE DRAWINGS

DESCRIPTION OF PREFERRED EMBODIMENT

Figure 1:
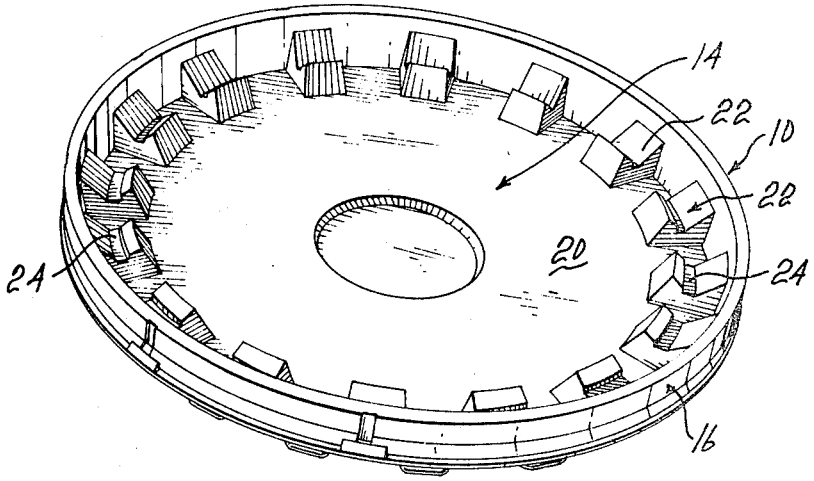
FIG. 1 is a top perspective view of a container lid made in accordance with the present invention.
Figure 2:
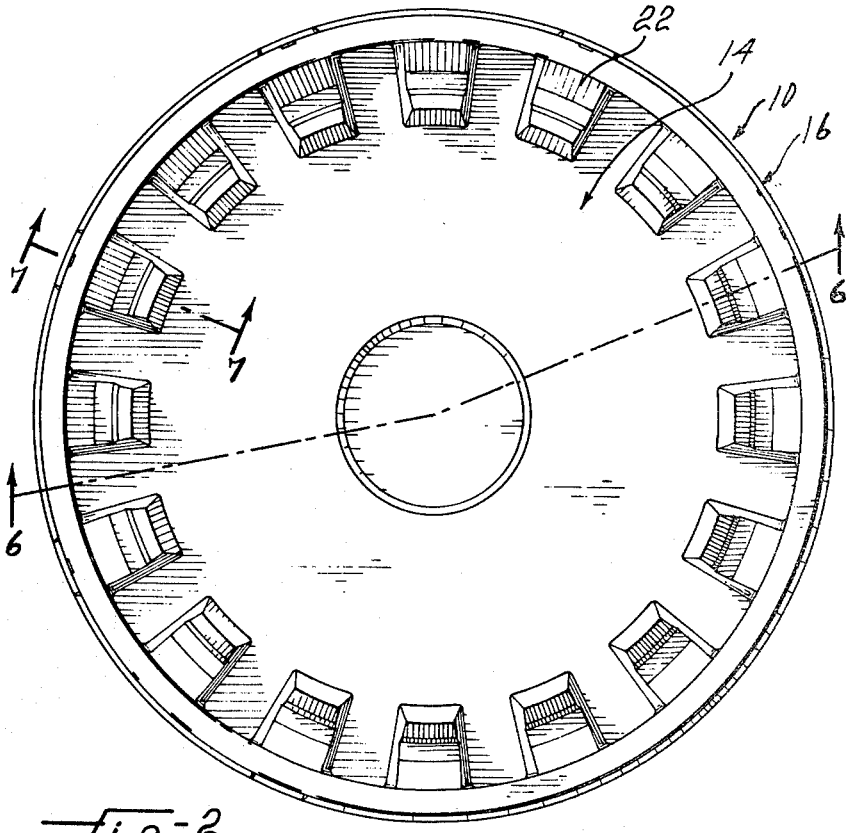
FIG. 2 is a top plan view thereof.
Figure 3:
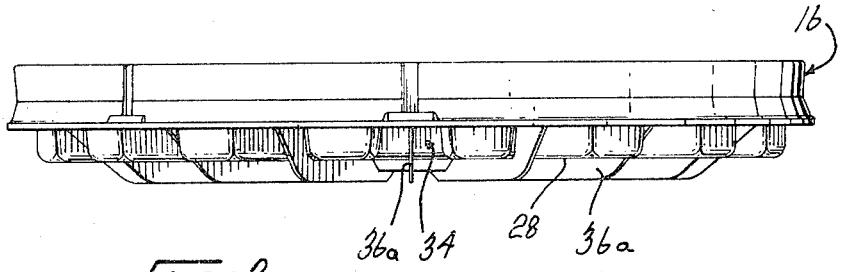
FIG. 3 is a side elevational view thereof.
Figure 4:
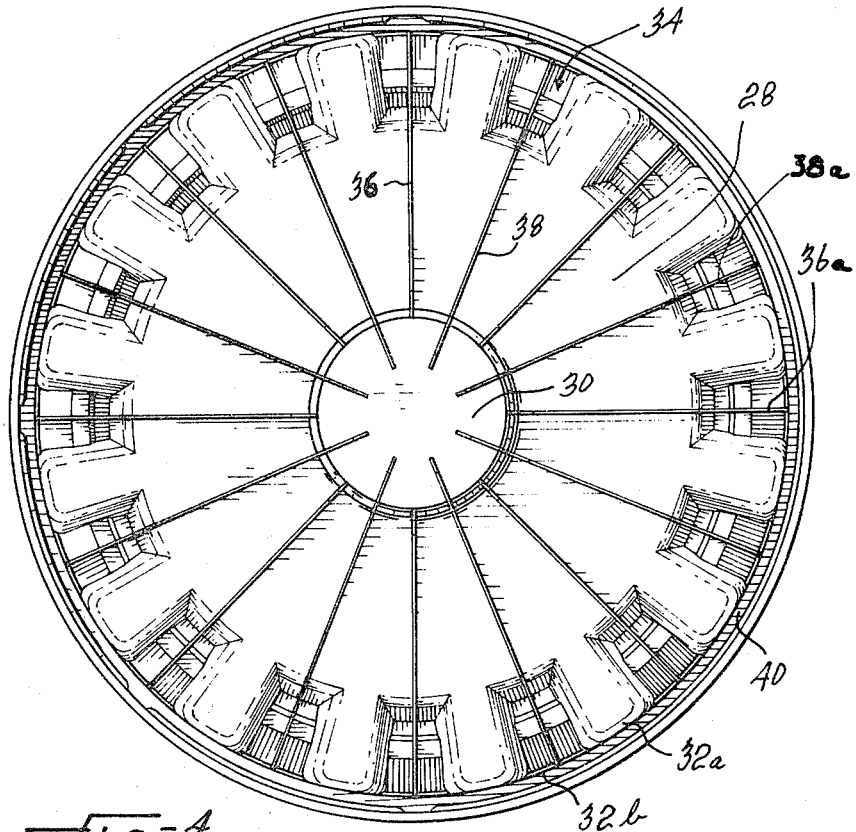
FIG. 4 is a bottom view thereof.
Figures 5, 6, 7:
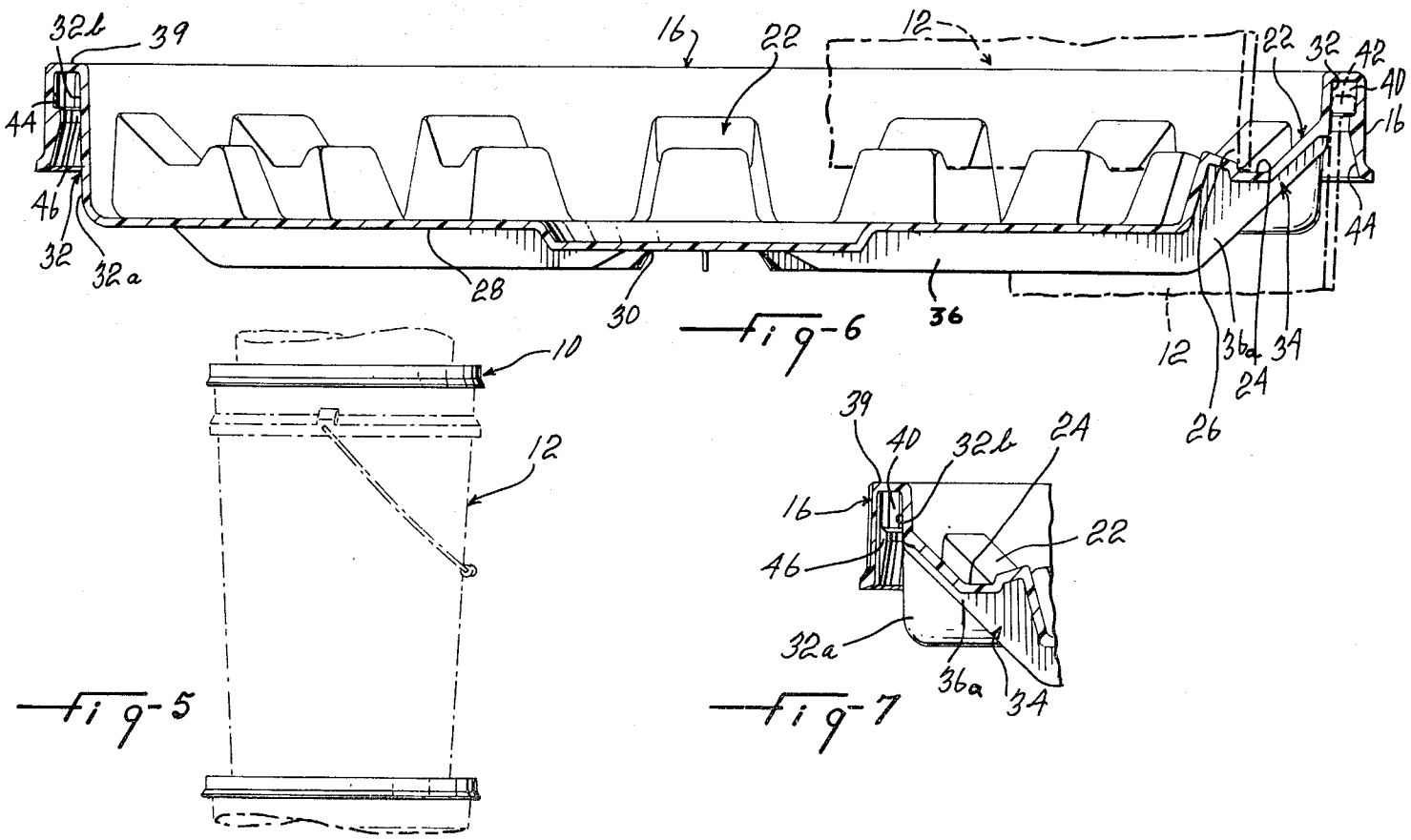
FIG. 5 is an elevation view showing the lid and container, in dotted lines, in a stackable arrangement.
FIG. 6 is a cross-sectional view taken along lines VI—VI of FIG. 2.
FIG. 7 is a cross-sectional view taken along lines VII—VII of FIG. 2.

Referring generally to the drawings, reference numeral 10 designates a container lid which is adapted to be mounted in sealed engagement with an opened top container 12 (see FIG. 5) of circular cross-section and tapering somewhat to maximum diameter at the top. The container and the lid may be made of any suitable material, preferably of plastics, such as polystyrene.

The lid comprises a generally circular body with a main central portion 14 and a downwardly extending peripheral lip portion 16. The top face 20 of the main central portion 14 comprises, at its peripheral portion, a series of circumferentially spaced blocks 22, each of which is formed of a top part that includes a recessed face 24 so as to receive the bottom edge 26 (shown in dotted lines in FIG. 6) thereby allowing containers to be superposed one on top of the other in a stackable arrangement.

The main central portion 14 has an underface 28 provided at its central portion with a circular downwardly projection 30, the function of which will be described hereinbelow. At the peripheral portion of the underface 28, a side wall, generally designated 32, extends upwardly with a lower peripheral portion **32*a* and an upper peripheral portion 32*b* (see FIGS. 6 and 7). The upper portion 32*b* of the side wall is uninterrupted while the lower portion 32*a* comprises a series of circumferentially spaced and inwardly directed vent cavities 34. It will be noted from FIGS. 6 and 7 that these cavities are the counterparts of blocks 22 on the top face 20 of the main central portion 14**.

The underface 28 also includes a series of radial guide ribs 36, 38 of different length extending from the central portion 30 to the side wall. The function of these guides will be described herebelow. These ribs terminate in the cavities 34 with upwardly inclined edges **36*a*, 38*a* which also serve to reinforce radially the blocks 22 on the top surface. These ribs have a certain height and they prevent the meat or fish products floating in brine inside the container to contact any air bubbles that could remain trapped at the undersurface of the lid. The ribs also serve to reinforce radially the underface of the lid when the latter is forced on solid parts, such as bones, thereby preventing bulging of the central portion of the body or of the side wall of the container 12**.

The downwardly extending lip portion 16 is contiguous with side wall 32 and is connected thereto by its flat horizontal portion 39. Upper portion 32*b* of the wall is spaced from lip 16 to define an area 40 into which the rim 42 of the container is received in a tight sealing engagement. The inner wall 44 of the lip portion 16 has a shoulder 46 to further provide a seat for rim 42 and additional sealing engagement between the container and the lid.

The principal advantage of the lid of the present invention will now be described in relation to the placing of the lid 10 on container 12 which, supposedly, has been prefilled with pickled products. The first parts of the lid to contact the products are the guides 36, 38. The central portion 30 of the underface initiate immediately an outward radial movement of the air and brine. The radial guides 38 assist in directing the flow of air and brine outward to the periphery of the lid. As the lower peripheral portion 32a contacts the rim 42 of the container, this constitutes a first engagement between the container and the lid. However, air and brine outflow is still permitted through the air cavities 34. Such outflow is maintained until rim 42 reaches the upper portion 32*b* of the side wall which is a full and uninterrupted wall. At this point, the cavities are now completely enclosed within the upper inner peripheral portion of the container. The lid is further forced into the container causing the rim 42 to force the flexible lip portion 16 outwardly and to snap into engagement in space 40 above shoulder 46. A tight engagement is obtained between the lid and the container as a result of the engagement of rim portion 42 with shoulder 46 of the lid. To provide additional sealing, a gasket (not shown) could be provided in the peripheral area 40 above rim portion 42. With the lid construction of the present invention, substantially all the air is expelled and should there remain a few air bubbles, the guides 36,38 prevent the meat or fish products from contacting said bubbles.

The embodiments of the invention in which an exclusive property or privilege is claimed are defined as follows:

1. A container lid for packaging principally air contaminative products comprising: a generally circular body having a main central portion and a downwardly extending peripheral lip portion adapted to snap over and engage the top rim portion of a container in sealed relationship; said main central portion including a top face and an underface, and terminating at the periphery thereof with an upstanding side wall contiguous with said lip portion, said side wall including an upper peripheral portion inwardly spaced from and defining with said lip portion a rim-receiving portion for said container; said side wall having a lower peripheral portion provided with a series of radially inward and circumferentially spaced cavities opening in said underface so that air and fluid filling said container may be expelled from said container even after said lower peripheral portion has come into engagement with the rim portion of said container; as said container lid is further pressed down into said container, the upper peripheral portion of said side wall sealingly engages the rim portion of said container.

2. A container lid as defined in claim 1, wherein said underface includes a central downwardly projecting portion to initiate radial air and fluid outflow toward said cavities as said lid is forced onto said container.

3. A container lid as defined in claim 2, wherein said underface includes a series of radial ribs to guide said air toward said cavities as said lid is pressed into said container and to prevent said products from contacting air bubbles which may be trapped at said underface.

4. A container lid as defined in claim 3, wherein said ribs include portions in said cavities to reinforce said lid in said cavities.

5. A container lid as defined in claim 1, wherein the inner wall of said downwardly extending peripheral lip portion comprises a shoulder contacting the outer wall of the peripheral rim portion of the container to further provide a sealing engagement between the lid and the container.

6. A container lid as defined in claim 1, wherein said top face comprises a series of circumferentially spaced blocks having a recessed top face to receive the bottom edge of a superposed container.

7. A container lid as defined in claim 6, wherein said blocks are counterparts of said cavities of said underface.

8. A container lid as defined in claim 7, comprising reinforcing ribs in said cavities for reinforcing said blocks.

* * * * *